US006733330B2

(12) United States Patent
Prost et al.

(10) Patent No.: US 6,733,330 B2
(45) Date of Patent: May 11, 2004

(54) TERMINAL BLOCK WITH A LOCKING ARM FOR A PLUG-IN CONNECTOR

(75) Inventors: Stephane Prost, Arnas (FR); Sylvain Barrat, Belleville sur Saone (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 10/192,644

(22) Filed: Jul. 11, 2002

(65) Prior Publication Data

US 2003/0022551 A1 Jan. 30, 2003

(30) Foreign Application Priority Data

Jul. 25, 2001 (FR) ..... 01 09939

(51) Int. Cl.[7] ..... H01R 13/60
(52) U.S. Cl. ..... 439/532; 439/716
(58) Field of Search ..... 439/532, 372, 439/716, 715

(56) References Cited

U.S. PATENT DOCUMENTS 4,070,081 A * 1/1978 Takahashi ..... 439/372

FOREIGN PATENT DOCUMENTS

| | | |
|---|---|---|
| CH | 652 242 A5 | 10/1985 |
| EP | 0 621 483 A1 | 10/1994 |
| EP | 1 052 731 A2 | 11/2000 |
| FR | 2 031 698 | 11/1970 |

* cited by examiner

*Primary Examiner*—Ross Gushi
(74) *Attorney, Agent, or Firm*—Oliff & Berridge, PLC

(57) ABSTRACT

This terminal block comprises;
an insulating casing in which at least one housing for accommodating a connector, which can be plugged into the housing in a direction (D), is provided,
means for locking the connector to the casing.

The locking means comprise:
at least one locking arm which:
is secured to the casing,
swings around an axis of rotation (Δ), between a withdrawal position and a locking position,
is equipped with a catching element intended to cooperate in the locking position with a complementary catching element of the connector,
means for immobilizing the arm in the locking position.

12 Claims, 3 Drawing Sheets

TERMINAL BLOCK WITH A LOCKING ARM FOR A PLUG-IN CONNECTOR

BACKGROUND OF THE INVENTION

The present invention relates to the technical field of terminal or interconnection blocks, which may or may not be modular, used to supply and control electrical plants.

In the above field, the invention more particularly relates to terminal blocks intended to accommodate one or more plug-in connectors.

Such terminal blocks generally comprise an insulating casing in which at least one housing for accommodating a plug-in connector is provided.

DESCRIPTION OF THE PRIOR ART

In order to prevent the inadvertent detachment of the terminal block from the connector due to the effect, for example, of vibration or else of forces exerted on the conductors connected to the connector, it has been proposed to implement means of locking the connector to the terminal block.

Thus, it has been proposed to provide, at the end of the connector intended to be engaged into the accommodating housing, a stop intended to cooperate with a complementary recess of the housing. The stop and its complementary recess effectively mike it possible to lock the connector onto the casing but, however, have the drawback of making it particularly difficult to remove the connector once the latter is connected to the terminal block. This is because, either the stop and its complementary recess are designed so that they do not offer very much resistance to the removal of the connector, in which case the locking function is not appropriately provided, or, on the other hand, the stop and its complementary recess are designed to offer considerable resistance to the removal of the connector, in which case the locking function is completely provided but it is virtually impossible to remove the connector without damaging the terminal block or the connector itself.

In order to overcome this drawback, it has been proposed to use a catching lug connected to the connector and intended to engage in a complementary stop of the terminal block, as a means of locking the connector to the terminal block. A lug of this sort is satisfactory in its function of locking the connector to the terminal block and, moreover, it allows easy unlocking when it is necessary to detach the connector from the terminal block.

However, the use of such a connected catching lug has the drawback of increasing the overall size of the connector. Furthermore, the connected lug catches on a stop provided in a side wall of the terminal block such that it is not possible to use such a catching lug for locking a connector plugged into a central region of the terminal block.

Moreover, since the catching lug is connected to the connector, it is necessary, when using the connector, to make provision for this catching lug which will increase the number of components needed to produce a junction and connection assembly. Furthermore, the catching lug has an overall size which makes it difficult to use in a cramped environment.

There therefore appears to be a need novel locking means which guard against the drawbacks above and which, especially, are simple to use and have a small overall size, while providing effective locking of the connector to the terminal block and with which there is no risk of loss.

SUMMARY OF THE INVENTION

In order to achieve these objectives, the invention relates to a terminal block which comprises an insulating casing in which at least one housing for accommodating a connector, which can be plugged into the housing in a direction (D), is provided, and means for locking the connector to the casing.

According to the invention, the terminal block is one in which the locking means comprise:

at least one locking arm which:

- is secured to the casing,
- swings around an axis of rotation (Δ), between a withdrawal position and a locking position,
- is equipped with a catching element intended to cooperate in the locking position with a complementary catching element of the connector, and means for immobilizing the arm in the locking position.

Thus, since the locking arm is secured to the terminal block, it is not possible to lose it. Furthermore, this permanent presence prevents any risk of oversight during mounting and assembly of a junction and connection assembly using one or more terminal blocks according to the invention.

According to one feature of the invention, in order to reduce as much as possible the overall size of the terminal block and the space dedicated, on the latter, to the locking means, the axis of rotation Δ of the arm is substantially perpendicular to the plug-in direction D of the connector.

The locking arm may be produced in any suitable manner and, according to a preferred feature of the invention, the locking arm has an elongate shape with an axis d and bears, at one end, the catching element, and at the opposite end, means for articulating to the casing.

The articulation means may then be produced in any suitable manner, such as for example in the form of a bearing intended to cooperate with a spindle borne by the casing of the terminal block. Similarly, the interconnection means may also be produced in the form of a spindle secured to the locking arm and intended to engage in a bearing provided on the insulating casing of the terminal block.

According to a preferred embodiment of the invention, the means of immobilizing the locking arm comprise a stop provided on the casing in order to support the arm in the locking position and to obstruct the passage of the arm into the withdrawal position from this locking position.

In a preferred embodiment of the invention, the locking arm then has, at its articulation end and away from the catching element, a heel intended to bear on the stop of the caning when the arm is in the locking position.

In order to offer high resistance to unlocking, especially under the effect of forces applied to the catching element by the locked connector, the heel is located opposite the housing accommodating the connector with respect to the axis Δ of rotation of the arm.

According to another feature of the invention, the immobilizing means comprise a rack provided on the casing and at least one tooth borne by the locking arm and intended to cooperate with the rack to impede the movement of the locking arm between its withdrawal position and its locking position, and vice versa. In a preferred, but not strictly necessary, manner, the rack is used in combination with the immobilizing stop provided on the casing.

According to the invention, the catching element of the locking arm can be provided in any suitable way, such as for example, in the form of a male or female catching element intended to cooperate with an element of complementary shape provided on the connector. According to a preferred embodiment, the catching element consists of a finger intended to cooperate with a stop offered by the connector to obstruct the removal of the connector from the accommodating housing. In a preferred, but not strictly necessary, manner, the stop of the connector consists of the edge of a cavity for accommodating the catching finger provided in the outer wall of the connector.

Moreover, according to a preferred, but not strictly necessary, embodiment, the arm has a cavity for accommodating an external maneuvering member, in order to facilitate the manipulation of the arm between the locking position and the withdrawal position and vice versa. In a preferred manner, this maneuvering cavity is provided at the end of the arm opposite the articulation end on the casing and has a shape suitable for accommodating the end of a screwdriver blade. Thus, when it is necessary to unlock the arm, it is possible to have available, by inserting the blade of a screwdriver into the maneuvering cavity, an arm with a considerable lever effect.

According to another feature of the invention, the locking arm has linking means intended to link the locking arm with another locking arm of an adjacent linking block.

The linking means may be provided in any suitable way, and, according to a preferred, but not strictly necessary, embodiment of the invention, the linking means comprise a peg provided on one side face of the arm, and a recess with a shape complementary to that of the peg, provided on the opposite side face of the locking arm.

The invention also relates to an assembly of at least two juxtaposed terminal blocks according to the invention. This assembly is one in which the locking arms of at least two adjacent terminal blocks are linked to each other.

This link may then result from using linking means as mentioned above and can therefore be dismantled. The link of the locking arm for adjacent blocks may also result from manufacturing the locking arms of two adjacent blocks as a single part. The production of the locking arms of more than two blocks, as a single part, may also be provided. Of course, this embodiment does not exclude the possibility of involving linking means which can be dismantled, provided in the side faces of the part constituting the juxtaposed linking arms.

BRIEF DESCRIPTION OF THE DRAWINGS

Various other features of the invention will emerge from the description below provided with reference to the appended drawings which illustrate various nonlimiting embodiments of one or more terminal blocks according to the invention.

DESCRIPTION OF THE PREFERRED EMBODIMENTS

Figure 1:
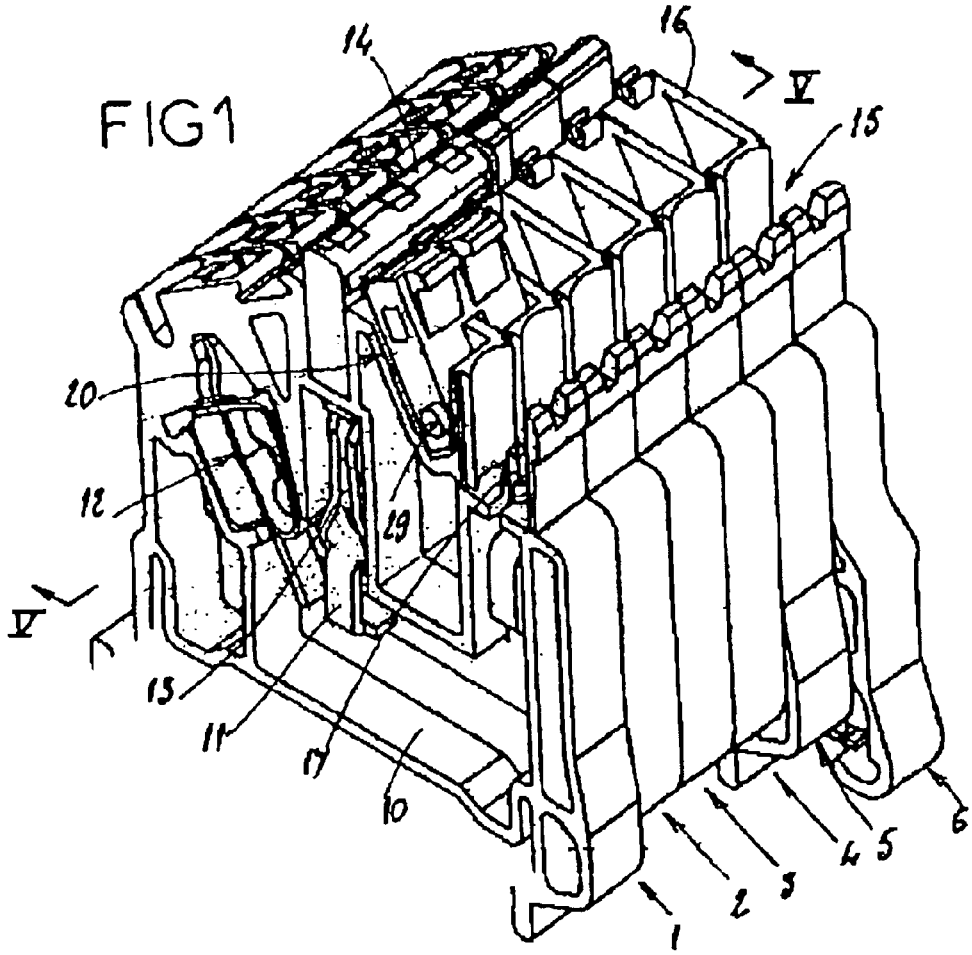
FIG. 1 is a perspective view of an assembly of juxtaposed terminal blocks according to the invention.

FIG. 1 illustrates an assembly of six juxtaposed terminal blocks 1 to 6 according to the invention.

Each terminal block comprises an insulating casing 10 in which an interconnection part 11 made from a conductive material is placed. The interconnection part 11 is then equipped with various connection accessories such as, for example, but not exclusively, a spring 12 for connecting an electrical cable, and a tuning fork contact 13 for connecting an interconnection comb 14. Of course, the interconnection part 11 could be equipped with any other interconnection accessory, such as for example a screw-in connectors, insulation-displacement connection systems, means of connecting plug-in connectors or else any other combination of these various accessories.

In accordance with an essential feature of the invention, the insulating casing 10 has at least one housing 15 for accommodating a plug-in connector 16, as emerges from FIG. 1. The interconnection part 11 is then equipped with a male or female connection device 17 intended to cooperate with the plug-in connector 16. According to the example illustrated, the connection device 16 is provided in the form of a pin of axis D corresponding to the plug-in direction of the connector onto the block 1. The connection device 17 of the terminal block could also consist of a female device intended, for example, to accommodate a pin of the connector.

In order to ensure pull-off resistance and a good ability to withstand vibrations from connecting the connector 16 to the insulating casing 10, the terminal block has means 20 for locking the connector 16 to the casing 10.

Figure 2:
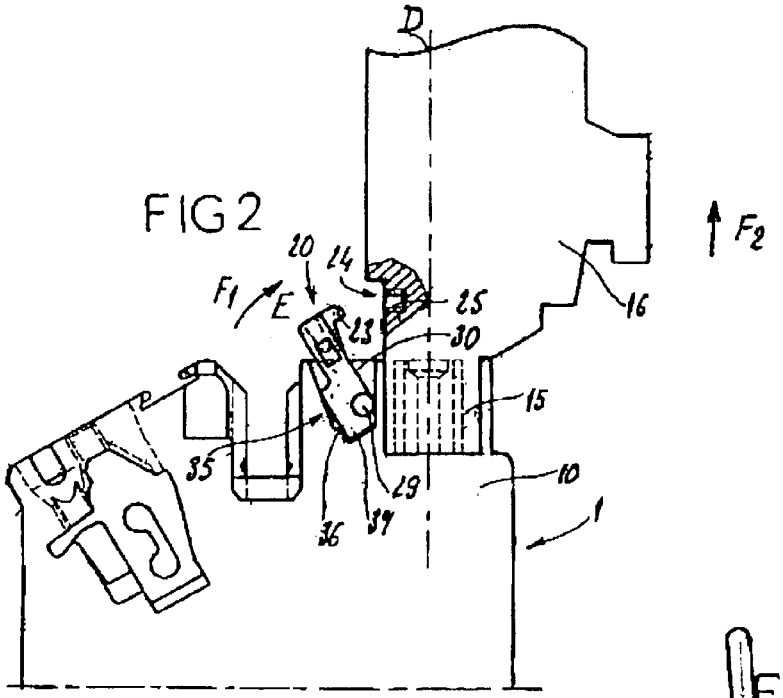
FIG. 2 is a side view of a terminal block according to the invention, the locking arm of which is in the withdrawal position.
Figure 3:
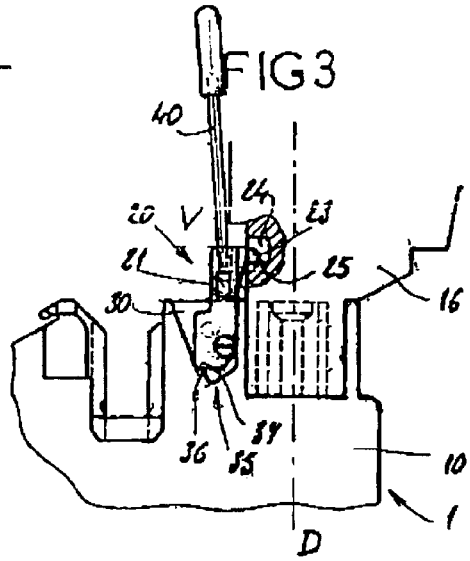
FIG. 3 is a view similar to FIG. 2 showing the arm of the terminal block in the locking position.

According to the invention, the locking means 20 comprise a locking arm 21 which is secured to the casing 10 and which is adapted, on the casing, so as to be able to swing around an axis of rotation Δ, between a withdrawal position E, more particularly illustrated in FIG. 2, and a locking position V, as illustrated in FIG. 3. So as to reduce the thickness of the casing 10 as much as possible, the axis of rotation Δ is preferably substantially perpendicular to the plug-in direction D.

Figure 4:
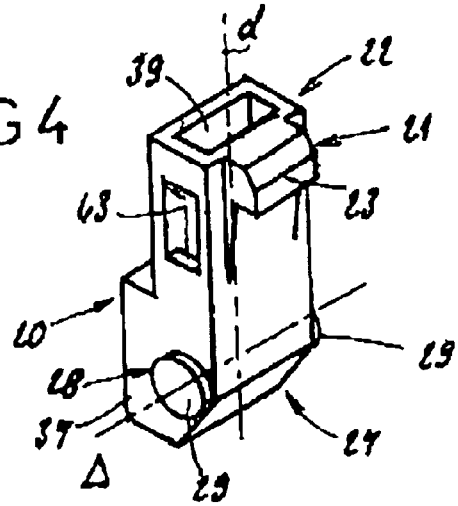
FIG. 4 is a perspective view of a locking arm for a terminal block according to the invention.

According to the preferred embodiment and as shown in FIG. 4, the arm 21 has an elongate, substantially parallelepipedal general shape with an axis d. The locking arm 21 then bears, at one of its ends 22 called a catching end, a catching element 23 intended to cooperate with a complementary catching element 24 of the connector 16. According to the example illustrated, the catching element 23 consists of a finger intended to bear, in the locking position, on a stop 25 defined by an edge of a cavity 24 which is, in the connector and which forms the complementary catching element of the finger 23.

Figure 5:
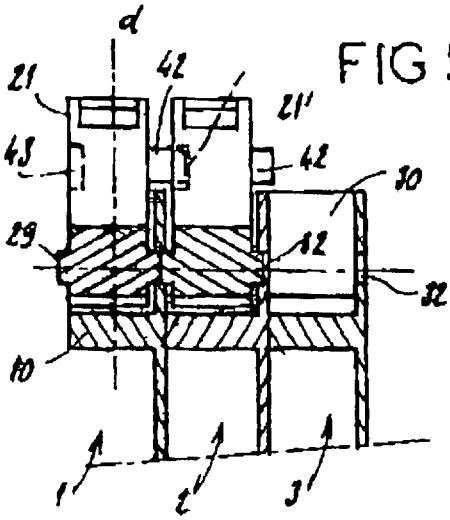
FIG. 5 is a section through the plane V—V of FIG. 1.

Moreover, the arm 21 comprises, at its end 27 away from the catching end 22, means 28 for articulating to the casing 10. The articulation means 28 may be provided in any suitable way and, according to the example illustrated, they consist of two pivots 29 of axis Δ each provided on a side face of the arm 21 and intended to engage in a complementary housing 32 offered by the casing 10, as is illustrated in FIG. 5. The arm 21 is then adapted to the casing 10 in a housing 30 provided close to the housing 15 for accommodating the connector 16.

The terminal block 1 thus constructed is used as follows.

Before putting the connector 16 in place, the arm 21 is placed in the withdrawal position E, as illustrated in FIG. 2.

In this withdrawal position E, the connector 16 may be freely put in place or removed from the housing 15 by a translational movement parallel to the plug-in direction D. When it is desired to lock the connector 16 to the terminal block, the arm 21 is moved in the direction of the arrow F1 until it is in the locking position V in which the finger 23 is engaged in the housing 24 of the connector 16 in order to bear against the stop 25 and thus oppose removal of the connector 16 in the direction of the arrow F2, as illustrated in FIG. 3.

In order to prevent the inadvertent unlocking of the arm 21, the locking means 20 further comprise means 35 for immobilizing the arm in the locking position V.

According to the example illustrated, the locking means 35 comprise a stop 36 provided in the bottom of the housing 30 in which the arm 21 is mounted. The stop 36 is then intended to offer support to a heel 37 of the articulating end 27 of the arm 21, when the arm 21 is in the locked position. The engagement of the heel 37 on the stop 36 immobilizes movements of the arm and thus prevents the arm 21 from returning to the withdrawal position. Thus, the locking position V corresponds to a stable position of the arm 21.

In order to provide the best possible resistance to tensile loads exerted in the direction of the arrow F2 on the connector 16, the heel 37 is located on the opposite side from the catching element 23, along a diagonal. In the same direction, the heel 36 is on the opposite side from the housing 15 with respect to the axis of articulation Δ of the arm 21. In the same direction, so as to prevent the inadvertent passage of the arm 21 into the locking position V from the withdrawal position E, the bottom of the housing for mounting the arm 21 is designed to prevent the arm 21 passing into the locking position. The withdrawal and locking positions thus correspond to two stable states of the arm 21.

To facilitate the maneuver of the arm 21 between its withdrawal B and locking V positions, the arm 21 preferably, but not strictly necessarily, comprises, at its end 22, a cavity 39 for accommodating a maneuvering member.

In the example illustrated, the cavity 39 is shaped to accommodate the blade of the screwdriver 40 which enables a lever effect to be used in order to mobilize the arm 21 from its locking position.

According to a preferred, but not strictly necessary, embodiment, the arm 21 further comprises means 41 for linking with the locking arm 21' of an adjacent terminal block 2. This advantageous arrangement of the invention makes it possible to ensure that the locking arms 21, 21' of the adjacent terminal blocks 1, 2 are in line with each other.

According to the example illustrated in FIG. 5, the linking means 41 are provided in the form, on the one hand, of a peg 42 provided in a side face of the locking arm 21 and, on the other hand, a recess 43, corresponding to the peg 42, provided in the side face opposite the locking arm 21. Thus the peg 42 of the linking arm 21 engages in the corresponding recess 43 of the adjacent locking arm 21' when the terminal blocks 1 and 2 are juxtaposed side by side.

However, according to the invention, the linking means may be produced in any other suitable form.

Figure 6:
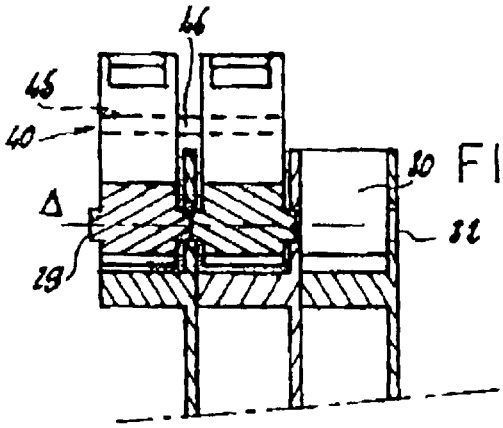
FIGS. 6 and 7 are sections similar to FIG. 5 showing another embodiment of terminal blocks according to the invention.

Thus, FIG. 6 illustrates another embodiment of the invention, in which the linking means 40, between the various locking arms 21, consist of a through bore 45 provided in each arm and enabling a linking rod 46 extending between the various locking arms 21, 21' to be connected.

According to the examples described above, the linking means 40, between the adjacent locking arms 21, 21', can be dismantled. However, according to the invention, this link is not necessarily dismantleable.

Figure 7:
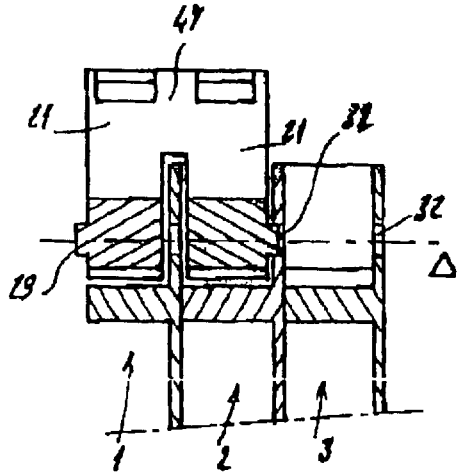

Thus, according to the example illustrated in FIG. 7, the linking means 40 are formed by a link segment 47 connecting the two linking arms 21. The two arms 21, 21' then form a one-piece assembly, such that it is not possible to detach them.

According to the examples described above, the means for immobilizing movement of the locking arm 21 solely comprise the stop 36 intended to cooperate with the heel 37 of the arm 21. However, according to the invention, the immobilizing means 20 can be produced in another form.

Figure 8:
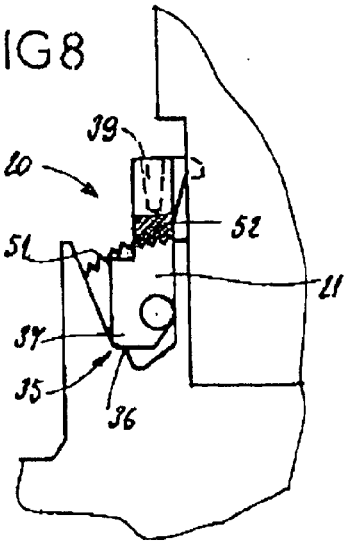
FIG. 8 is a view similar to FIG. 3 showing another embodiment of the locking means for a terminal block according to the invention.

Thus, FIG. 8 illustrates a variant embodiment in which the stop 36 and the heel 37 are supplemented with a rack 51 provided on the casing 10, the rack is then intended to cooperate with at least one and, according to the example illustrated, several teeth 52 provided on the arm 21. Friction and the engagement of the teeth 52, on the rack 51, then impede the movements of the arm 21 and thus make it possible to reinforce its immobilization, especially in the locked position.

Of course, according to the invention, the rack 51 and the teeth 52 could be implemented below as immobilizing means 20, without addition of the immobilization provided by the stop 36 and the heel 37.

The invention is not limited to the examples described above and various modifications may be provided thereto without departing from its scope.

What is claimed is:

1. A terminal block of the type comprising:

an insulating casing in which at least one housing for accommodating a connector, which can be plugged into the housing in a direction, is provided; and means for locking the connector onto the casing, the locking means comprising:

at least one locking arm which:

is secured to the casing;

swings around an axis of rotation, between a withdrawal position and a locking position; and is equipped with a catching element intended to cooperate in the locking position with a complementary catching element of the connector; and means for immobilizing the locking arm in the locking position, the means for immobilizing the locking arm in the locking position located at a bottom of the casing and next to an articulating end of the locking arm, wherein the locking arm has an elongate shape with an axis and bears, at one end, the catching element and, at the opposite, articulating end, means for articulating to the casing.

2. The terminal block as claimed in claim 1, wherein the axis of rotation of the arm is substantially perpendicular to a plug-in direction of the connector.

3. The terminal block as claimed in claim 1, wherein the immobilizing means comprise a stop provided on the casing in order to support the arm in the locking position and to obstruct passage of the arm to the withdrawal position.

4. The terminal block as claimed in claim 1, wherein the immobilizing means comprise:

a rack provided on the casing, and at least one tooth borne by the locking arm and intended to cooperate with the rack in order to impede the movement of the arm.

5. The terminal block as claimed in claim 1, wherein the catching element of the arm consists of a finger intended to cooperate with a stop, offered by the connector, in order to obstruct the removal of the connector from the accommodating housing.

6. An assembly of at least two juxtaposed terminal blocks, as claimed in claim 1, wherein the locking arm of at least two adjacent terminal blocks are linked to each other.

7. The terminal block as claimed in claim 1, wherein the immobilizing arm has, at its articulating end and away from the catching element, a heel intended to bear on a stop provided on the casing, in the locking position of the arm.

8. The terminal block as claimed in claim 7, wherein the heel is located opposite the housing with respect to the axis of rotation of the arm.

9. The terminal block as claimed in claim 1, wherein the arm has a cavity for accommodating a maneuvering member.

10. The terminal block as claimed in claim 9, wherein the cavity is shaped in order to accommodate the end of a screwdriver blade.

11. The terminal block as claimed in claim 1, wherein the locking arm has linking means intended to link the locking arm with another locking arm of an adjacent linking block.

12. The terminal block as claimed in claim 11, wherein the linking means comprise a peg, provided on a side face of the arm and a recess of a shape complementary to that of the peg, provided in the opposite side face of the locking arm.

* * * * *